US008943969B2

(12) United States Patent
Castillo et al.

(10) Patent No.: US 8,943,969 B2
(45) Date of Patent: Feb. 3, 2015

(54) FLEXO CUSHION

(76) Inventors: Maria Teresa A. Castillo, Spring Valley, CA (US); Jeffrey Knight, Carlsbad, CA (US)

( * ) Notice: Subject to any disclaimer, the term of this patent is extended or adjusted under 35 U.S.C. 154(b) by 2104 days.

(21) Appl. No.: 12/037,429

(22) Filed: Feb. 26, 2008

(65) Prior Publication Data

US 2009/0211480 A1 Aug. 27, 2009

(51) Int. Cl.
*B41D 7/00* (2006.01)
*B41F 27/06* (2006.01)

(52) U.S. Cl.
USPC ..... 101/493; 101/376

(58) Field of Classification Search
USPC ..... 101/493, 375, 376
See application file for complete search history.

(56) References Cited

U.S. PATENT DOCUMENTS

| | | | | |
|---|---|---|---|---|
| 3,645,204 | A * | 2/1972 | Gosnell | 430/281.1 |
| 4,846,063 | A | 7/1989 | Brown | |
| 4,862,800 | A * | 9/1989 | Wieland et al. | 101/415.1 |
| 5,264,873 | A | 11/1993 | Fiscella et al. | |
| 5,507,228 | A * | 4/1996 | Schulz | 101/375 |
| 5,561,730 | A * | 10/1996 | Lochkovic et al. | 385/114 |
| 5,894,799 | A * | 4/1999 | Bart et al. | 101/376 |
| 6,247,403 | B1 | 6/2001 | Randazzo | |
| 6,312,122 | B1 * | 11/2001 | Brown et al. | 347/101 |
| 6,666,138 | B2 | 12/2003 | Randazzo | |
| 6,706,389 | B1 | 3/2004 | Bates et al. | |
| 6,811,863 | B2 | 11/2004 | Rizika et al. | |
| 7,063,016 | B2 | 6/2006 | Bitton | |
| 7,270,873 | B2 | 9/2007 | Rizika et al. | |
| 2003/0045646 | A1 * | 3/2003 | Buono et al. | 525/329.1 |
| 2003/0129384 | A1 * | 7/2003 | Kalchbrenner | 428/317.9 |
| 2004/0103804 | A1 * | 6/2004 | McLean et al. | 101/375 |
| 2005/0227165 | A1 * | 10/2005 | Yamada et al. | 430/270.1 |
| 2006/0029880 | A1 * | 2/2006 | McMillen et al. | 430/199 |
| 2006/0137551 | A1 * | 6/2006 | Piolat | 101/375 |
| 2008/0124110 | A1 * | 5/2008 | Hamilton et al. | 399/69 |
| 2008/0131590 | A1 * | 6/2008 | Drews et al. | 427/97.3 |

FOREIGN PATENT DOCUMENTS

| | | |
|---|---|---|
| NL | 8302811 | 3/1985 |
| WO | WO 94/04362 | 3/1994 |
| WO | 01/70505 | 9/2001 |
| WO | WO 2005/062126 A1 | 7/2005 |

OTHER PUBLICATIONS

Sartomer Product Detail CN990.*

* cited by examiner

*Primary Examiner* — Blake A Tankersley
(74) *Attorney, Agent, or Firm* — Carmody Torrance Sandak & Hennessey LLP

(57) ABSTRACT

A method of improving performance of a relief image printing plate on a printing cylinder which includes mounting a compressible cushion element on a surface of the printing cylinder. The surface of the cushion element that is contactable with the relief image printing plate is a low friction surface that allows a relief image printing plate to slide freely across its surface and settle into position on the printing cylinder. The use of a cushion element having a low friction surface reduces smut and improves registration of the printing plate on the printing cylinder.

22 Claims, 1 Drawing Sheet

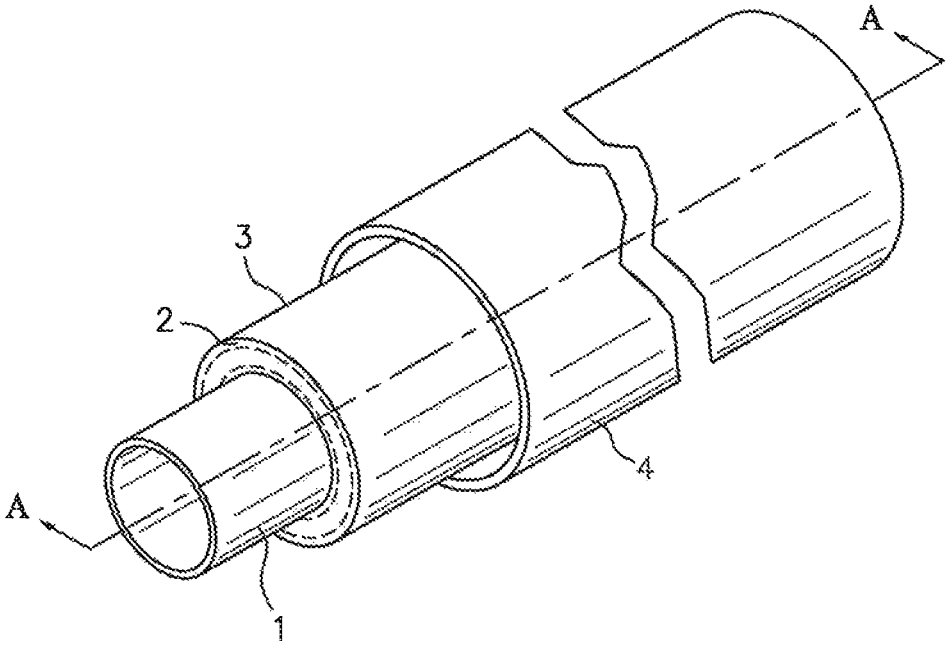
A
3
2
4
A
1

FLEXO CUSHION

FIELD OF THE INVENTION

The present invention relates to a method of improving image registration on a printing cylinder during printing by flexographic plates.

BACKGROUND OF THE INVENTION

Flexography applies broadly to printing processes that utilize a flexible substrate bearing an elastomeric or rubbery relief surface. Flexographic printing plates are well known for use in printing, particularly on surfaces which are soft and easily deformable, such as packaging materials, e.g., cardboard, plastic films, etc. Flexographic printing plates can be prepared from photopolymerizable materials comprising an elastomeric binder or binders, one or more monomers and a photoinitiator. Photosensitive elements used to manufacture flexographic printing plates generally have at least one layer of photopolymerizable material interposed between a support and a peelable coversheet or a multilayer cover element. Upon imagewise exposure to actinic radiation, the at least one photopolymerizable layer polymerizes in the exposed areas causing insolubilization of the exposed photopolymerizable composition. Development, such as with a suitable solvent or by thermal blotting, removes the unexposed areas of the photopolymerizable layer leaving behind a printing relief which can be used for flexographic printing.

After development, the relief image printing plates are mounted to print cylinders to perform the printing operation. When the printing plate is mounted to the print cylinder, a high degree of accuracy of mounting of the plate to the cylinder is necessary so that the relief image is properly aligned, or registered. Accurate standards must be followed in affixing the printing plate to the cylinder to prevent images on the finished work from being blurred or overlapping. Registration is especially critical when more than one color of ink is involved. For example, when printing in full color, there are typically four separate printing plates, each having its own ink. Each printing plate has a different coverage area that contributes to the overall image being printed. If the printing plates are not in proper registration, the image will appear fuzzy.

Historically, in packaging printing, to mount the flexographic plates to the printing cylinder, vinyl sheets having adhesives coated on each side, commonly referred to as "stickyback," have been used. Plates are mounted with a partial or an entire layer of stickyback between the plate and the printing cylinder. However, these vinyl sheets are incompressible, thin and tend to vary in caliper. In addition, the printing plate, printing cylinder, gears, substrate and impression cylinder each tend to have variation in tolerances in surface smoothness and height or thickness. Such inaccuracies dictate the use of increased pressure in the printing process, but the increased pressure can in turn cause deterioration in print quality due to yielding under pressure of the flexographic printing plates. Undesirable results including a dirty appearance of printing and inaccurate reproduction of halftones, (e.g., oval dots or halos around characters and images) may occur. The increased use of thinner plates formed by photopolymerization techniques, further accentuate the resulting problems associated with printing with non-uniform materials.

In an effort to overcome the shortcomings of the stickyback sheet, layers of synthetic polymeric foam as backing materials or as tapes have been suggested for use in mounting flexographic plates onto the printing cylinder. The polymeric foam materials are compressible and thus have sufficient cushioning effect to compensate for the variations in thickness or surface height of the plate, plate cylinder, gears, substrate and impression cylinder. In addition, the foam materials are selected to have sufficient resiliency to rebound rapidly and repeatedly to the original dimensions during printing. However, during use, these polymeric foam materials can fatigue, because the foam loses compressibility and resiliency, and cannot rebound to its original dimensions. In order to compensate for the loss of compressibility, other compressible materials, such as elastomeric materials, have also been used. Furthermore, it has also been suggested to use elastomeric materials that have various relief surfaces such as open-cells (i.e., open cells having total void volume in excess of 40 percent as described for example in U.S. Pat. No. 5,894,799 to Bart et al., the subject matter of which is herein incorporated by reference in its entirety) or longitudinal protrusions, as described for example in U.S. Pat. Nos. 6,247,403 and 6,666,138 to Randazzo, the subject matter of each of which is herein incorporated by reference in its entirety.

Thus it can be seen that it is important that the cushion element be sufficiently resilient to rebound rapidly and repeatedly from the compressed state to the original dimensions during printing with no or only minimal fatigue over time. The cushion element must also be sufficiently compressible to compensate for variations in thickness or surface height of the plate, plate cylinder, gears, substrate and impression cylinder during printing. However, there are still additional improvements needed to provide a cushion element that also reduces smutting and improves image registration, especially during printing by metal-backed flexo plates.

Therefore, it would be desirable to provide an improved cushion element that overcomes the deficiencies of the prior art. To that end, the inventors of the present invention have determined that a beneficial result can be obtained by integrating low friction surfaces directly into the cushion element itself for use on flexographic presses, especially those designed for metal-backed plates flexographic plates.

The improved process of the present invention does not require any spraying of the printing plate itself and does not expose the press operator to any volatile chemicals. In addition, the improved process of the present invention does not require any expensive coating to the back of the plate. Finally, the improved process of the present invention enables the use of thinner (and less expensive) plates for printing. Along with thinner plates, the present invention also increases the tonal range of the imaged plates.

DESCRIPTION OF THE DRAWING

FIG. 1 shows a cut away of the basic embodiment of this invention, showing:

1. Printing cylinder.
2. Compressible layer.
3. Low friction surface of the compressible layer.
4. Relief image printing plate.

SUMMARY OF THE INVENTION

It is an object of the present invention to provide a cushion element for a printing cylinder that reduces smutting during printing by flexographic plates, especially metal backed flexographic plates.

It is another object of the present invention to provide a cushion element for a printing cylinder that improves registration during printing by metal-backed flexo plates.

It is still another object of the present invention to provide a cushion element that allows for the use of thinner printing plates.

It is still another object of the present invention to provide a cushion element that improves the tonal range of imaged printing plates.

To that end, the present invention relates generally to a cushion element for a printing cylinder that comprises a low friction surface and a method of using the cushion element to improve registration of a relief image printing plate on a printing cylinder, the method comprising the steps of:

a) mounting a compressible cushion element on a surface of the printing cylinder, wherein a surface of the cushion element that is contactable with the relief image printing plate is low friction; and b) mounting the relief image printing plate on the compressible cushion element, whereby the low friction surface of the cushion element allows the relief image printing plate to slide freely across its surface and settle into position on the printing cylinder.

DETAILED DESCRIPTION OF THE PREFERRED EMBODIMENTS

The present invention relates generally to the integration of low friction surfaces in cushions used on flexographic presses designed for metal-backed plates. As discussed above, cushions are used in flexographic printing because of their compressibility properties to help compensate for the various mechanical tolerances encountered in the printing process. Physical properties of the cushion such as durometer, compression set and resilience are important with respect to compressibility.

The present invention incorporates a low-friction surface in the cushion to allow the printing plate to slide freely across its surface. This in turn facilitates the ability of the plate to settle into its optimum position on the press cylinder. Plates not able to move freely frequently do not lay flat and/or do not find their optimum position. Plates that do not lay flat often smut in the non-image area, and plates that lay in the wrong position cause poor image registration. The cushion element is used to support the printing plate in place during printing. It is necessary for the plate to be easily repositionable to ensure that the final document is in register and lies as flat as possible.

The present invention relates generally to a method of improving registration of a relief image printing plate on a printing cylinder, the method comprising the steps of:

a) mounting a compressible cushion element on a surface of the printing cylinder, wherein a surface of the cushion element that is contactable with the relief image printing plate is low friction; and b) mounting the relief image printing plate on the low friction surface of the compressible cushion element, whereby the low friction surface of the cushion element allows the relief image printing plate to slide freely across its surface and settle into position on the printing cylinder.

The low-friction compressible cushion element usable in the process of the invention typically comprises:

a) an adhesive layer that is capable of being affixed to a surface of the printing cylinder; and b) a compressible layer comprising a material selected from the group consisting of an elastomer, rubber, foam and combinations of one or more of the foregoing, and having a low friction surface provided thereon by a method comprising one of:

i) incorporating a low friction additive into the compressible layer; or ii) providing a top layer on the compressible layer, said top layer comprising a low friction additive.

Elastomeric materials are those which at room temperature can be deformed under low stress and will return to its original dimension/s upon removal of the stress. Any elastomeric material is suitable for use as the cushion element providing a relief of open-cells can be formed in the material. Elastomeric materials include vulcanized rubbers, both natural and synthetic, as well as modified high polymers. Suitable elastomeric materials include, but are not limited to, polybutadiene; polyisoprene; polychloroprene; and olefin copolymers such as styrene-butadiene copolymers, nitrile rubbers (e.g., acrylonitrile-butadiene copolymer), ethylene-propylene copolymers, and butyl rubber (e.g., isobutylene-isoprene copolymer). Elastomers which are thermoplastic are also suitable as the cushion layer and include, but are not limited to, styrene-diene-styrene triblock copolymers, such as polystyrene-polybutadiene-polystyrene (SBS), polystyrene-polyisoprene-polystyrene (SIS), or polystyrene-poly(ethylenebutylene)-polystyrene (SEBS); thermoplastic polyester and polyurethane elastomers; and thermoplastic polyolefin rubbers (polyolefin blends). Suitable elastomers also include chlorosulfonated polyethylene, polysulfide, polyalkylene oxides, polyphosphazenes, elastomeric polymers and copolymers of acrylates and methacrylates, and elastomeric copolymers of vinyl acetate and its partially hydrogenated derivatives.

The cushion element can also include a support for the compressible layer. The support can be made of any metallic or polymeric film material which is dimensionally stable. Typically, the support will have an adhesion promoting surface or a layer of adhesive to assure that the compressible layer adheres to the support. In addition, the support can be treated with flame-treatment or electron-treatment to promote adhesion between the support and the compressible layer.

As discussed above, the low friction surface may be provided on the compressible layer by either a) incorporating a low friction additive into the compressible layer; or b) providing a top layer on the compressible layer, said top layer comprising a low friction additive.

Low-friction additives and materials include, for example, organosilicones, silicone polymers, siliconized urethane acrylates, silicon surfactants, silicone acrylates, silicone methacrylates, fluorinated acrylates, fluorinated methacrylates, fluorocarbons, fluoropolymers, waxes, silicas, glass, ceramic or polymer microspheres, and the like, used alone or in combination. In a preferred embodiment of the invention the low friction additive s are Zeeosphere W610 ceramic microspheres from 3M and SR-990 silicone urethane acrylate from Sartomer Company. These low friction additives may be added directly to the cushion material (ie. directly to the elastomer, rubber or foam) such that the natural surface of the cushion will be low friction, or used in a top layer applied onto the surface of the underlying elastomeric layer.

If the top layer approach is used, the top layer can be applied in any of a number of ways known to those skilled in the art, including for example spraying, roll coating, extrusion, curtain coating, etc. onto the cushion material. The layer can also be dried-in-place or thermally or UV-cured, as long as it is firmly attached to the underlying cushion material.

The low friction coating of the invention is selected so that the cushion element has a slide angle of less than about 33° (coefficient of friction (COF)<0.65), and preferably less than about 30° (COF <0.58), based on a modification of TAPPI standard method T-815. Slide angle measurements were made using a metal printing plate substrate sample affixed to the inclined plane and the cushion of the invention attached to the sliding block. In addition, it is also desirable that the cushion element of the invention have a Shore A durometer of between about 40 and 80 (ASTM method D2240) and a resilience (ASTM method D2632) of between about 10 and 65%.

The surface of the cushions can be continuous or composed of an open-cell relief, as described for example in U.S. Pat. No. 5,894,799 to Bart et al. or longitudinal protrusions, as described for example in U.S. Pat. Nos. 6,247,403 and 6,666,138 to Randazzo, the subject matter of each of which is herein incorporated by reference in its entirety. Other surface configurations are also usable in the practice of the present invention. If protrusions are used, the cushion may be mounted so that the protrusions engage the bottom of the flexographic printing plate or conversely so that the protrusions engage the surface of the plate cylinder. Preferably, the protrusions would engage the print cylinder surface and be essentially inverted to the flexographic printing plate surface. However, in either configuration, it is important that the protrusion strips are disposed to run parallel or in the direction of the circumferential drum rotation.

The improved cushion technology of the invention is designed to work particularly well with metal-backed flexographic plates that are affixed to the press cylinder by magnetic and/or mechanical lock-ups as is generally well known in the art. The metallic substrate provides a stable base structure for the photopolymerizable layer, allows for heated development at higher temperatures and allows for effective mounting on the printing press. The metallic substrate may comprise various metals or alloys, including but not limited to, steel, stainless steel, aluminum, nickel, copper and alloys of one or more of the foregoing. The thickness of the metallic substrate depends on the particular application but is typically in the range of about 4 to about 12 mils.

The metal-backed flexographic relief image printing plate typically comprises the metallic substrate layer and one or more photopolymerizable layers disposed thereon. A removable coversheet may be disposed on the photopolymerizable layer to protect the printing element during storage and handling. In addition, while printing plates with thicknesses of from about 12 to 107 mils can be used with the cushions of the invention, the benefits are more significant for plates that are less than about 25 mils in total thickness.

The photopolymerizable layer allows for the creation of the desired image and provides a printing surface. The photopolymers used in the photopolymerizable layer generally comprise binders, monomers, photoinitiators and other performance additives. Photopolymer compositions useable in the practice of the invention includes for example those described in WO 2005/062126 to Roberts et al., the subject matter of which is herein incorporated by reference in its entirety, as well as compositions described in the references cited by Roberts et al. Various photopolymers such as those based on polystyrene-isoprene-styrene, polystyrene-butadiene-styrene, polyurethanes, and/or thiolenes as binders are preferred. Especially preferred binders include polystyrene-isoprene-styrene and polystyrene-butadiene, styrene, especially block co-polymers of these compounds.

While the invention has been described above with reference to specific embodiments thereof, it is apparent that many changes, modifications, and variations can be made without departing from the inventive concept disclosed here. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A method of improving the performance of a relief image printing plate on a printing cylinder, the method comprising the steps of:

a) mounting a compressible cushion element on a surface of the printing cylinder, wherein the compressible cushion element comprises a compressible layer selected from the group consisting of an elastomer, rubber, foam and combinations of one or more of the foregoing, wherein the cushion element comprises a low friction surface that is contactable with the relief image printing plate, and wherein a coefficient of static friction between the cushion element and the relief image printing plate is less than 0.65; and b) mounting the relief image printing plate on the low friction surface of the compressible cushion element, whereby the low friction surface of the cushion element allows the relief image printing plate to slide across its surface and settle into position on the printing cylinder.

2. The method according to claim 1 wherein the compressible cushion element comprises an adhesive layer that is capable of being affixed to the surface of the printing cylinder; and (ii)

wherein the compressible layer comprises a low friction surface provided thereon by a method comprising one of:

(i) incorporating a low friction additive into the compressible layer; or (ii) providing a top layer on the compressible layer, said top layer comprising a low friction additive.

3. The method according to claim 2, wherein the compressible layer has the low friction additive dispersed therein to provide the low friction surface on the compressible layer.

4. The method according to claim 2, wherein a top layer comprising a low friction additive is disposed on the compressible layer.

5. The method according to claim 4, wherein the top layer is applied to the compressible layer of the cushion element by a method selected from the group consisting of spraying, roll coating, extrusion, curtain coating, and combinations of one or more of the foregoing.

6. The method according to claim 5, wherein the top layer is dried-in-place or thermally or UV-cured, whereby the top layer is firmly attached to the compressible layer.

7. The method according to claim 2, wherein the low friction additive is selected from the group consisting of organosilicones, silicone polymers, siliconized urethane acrylates, silicon surfactants, fluorocarbons, silicone acrylates, silicone methacrylates, fluorinated acrylates, fluorinated methacrylates, fluoropolymers, waxes, silicas, glass microspheres, ceramic microspheres, polymer microspheres and combinations of one or more of the foregoing.

8. The method according to claim 7, wherein the low friction additive comprises at least one material selected from the group consisting of ceramic microspheres, silicone urethane acrylates and mixtures thereof.

9. The method according to claim 2, wherein the slide angle between the low friction surface of the cushion element and the relief image printing plate is less than about 33°.

10. The method according to claim 9, wherein the slide angle between the low friction surface of the cushion element and the relief image printing plate is less than about 30°.

11. The method according to claim 2, wherein the resilience of the cushion element is between about 10 and 65%.

12. The method according to claim 1, wherein the surface of the cushion element that is contactable with the relief image printing plate is continuous.

13. The method according to claim 1, wherein the surface of the cushion element that is contactable with the flexographic printing plate comprises an open cell relief or longitudinal protrusions.

14. The method according to claim 1, wherein the cushion element has a Shore A durometer of between about 40 and about 80.

15. The method according to claim 1, wherein the relief image printing plate comprises a metallic substrate layer and a photopolymerizable layer.

16. The method according to claim 15, wherein the relief image printing plate has a thickness between about 12 and 107 mils.

17. The method according to claim 16, wherein the relief image printing plate has a total thickness of less than about 25 mils.

18. A low-friction compressible cushion element used for cushioning a relief image printing plate on a printing cylinder, the cushion element comprising:

a) an adhesive layer that is capable of being affixed to a surface of the printing cylinder; and b) a compressible layer comprising a material selected from the group consisting of an elastomer, rubber, foam and combinations of one or more of the foregoing, and having a low friction surface provided thereon by a method comprising one of:

(i) incorporating a low friction additive into the compressible layer; or (ii) providing a top layer on the compressible layer, said top layer comprising a low friction additive.

19. The low-friction compressible cushion element according to claim 18, wherein the compressible layer has the low friction additive dispersed therein to provide the low friction surface on the compressible layer.

20. The low-friction compressible cushion element according to claim 18, wherein a top layer comprising a low friction additive is disposed on the compressible layer.

21. The low-friction compressible cushion element according to claim 18, wherein the low friction additive is selected from the group consisting or organosilicones, silicone polymers, siliconized urethane acrylates, silicon surfactants, fluorocarbons, silicone acrylates, silicone methacrylates, fluorinated acrylates, fluorinated methacrylates, fluoropolymers, waxes, silicas, glass microspheres, ceramic microspheres, polymer microspheres and combinations of one or more of the foregoing.

22. The low-friction compressible cushion element according to claim 21, wherein the low friction additive comprises at least one material selected from the group consisting of ceramic microspheres, silicone urethane acrylates and mixtures thereof.

* * * * *